United States Patent [19]

Hunt, Jr. et al.

[11] 4,025,186

[45] May 24, 1977

[54] WEB INDICIA FOR SYNCHRONIZING CONTROL APPARATUS FOR ELECTROPHOTOGRAPHIC APPARATUS UTILIZING DIGITAL COMPUTER

[75] Inventors: William E. Hunt, Jr.; John L. Connin; Douglas J. Steelman, all of Rochester, N.Y.

[73] Assignee: Eastman Kodak Company, Rochester, N.Y.

[22] Filed: Feb. 13, 1975

[21] Appl. No.: 550,104

Related U.S. Application Data

[60] Division of Ser. No. 481,436, June 20, 1974, Pat. No. 3,914,047, which is a continuation of Ser. No. 402,223, Oct. 1, 1973, abandoned.

[52] U.S. Cl. ..... 355/14; 355/16

[51] Int. Cl.² ..... G03G 15/00

[58] Field of Search ..... 355/16, 3 BE, 14, 40, 355/41, 64

[56] References Cited

UNITED STATES PATENTS

| | | | |
|---|---|---|---|
| 3,521,950 | 7/1970 | Gardner et al. | 355/3 BE |
| 3,606,532 | 9/1971 | Shelffo et al. | 355/3 BE |
| 3,720,002 | 3/1973 | Lloyd | 355/14 |
| 3,768,904 | 10/1973 | Rodek | 355/14 |
| 3,785,730 | 1/1974 | Weber | 355/16 |
| 3,912,390 | 10/1975 | Van Herten | 355/14 |
| 3,922,380 | 11/1975 | Rowell et al. | 355/16 |

*Primary Examiner*—L. T. Hix
*Assistant Examiner*—J. A. LaBarre
*Attorney, Agent, or Firm*—R. L. Owens

[57] ABSTRACT

Electrophotographic copying apparatus is disclosed having an elongated electrosensitive web defining a plurality of selectable image areas and having a plurality of perforations formed along an edge therein and movable along an endless path relative to a plurality of actuable work stations disposed along the path. The work stations are operative when actuated to perform a work operation on a selected image area of the web, respectively. The apparatus includes means disposed at a fixed location along the path for sensing the perforations to produce signals, a logic and control unit having a programmable computer with a stored program and responsive to such perforation signals for actuating the work stations in accordance with the program to cause the work stations to perform work operations on the web in timed relation to movement of selected image areas along the path respectively.

14 Claims, 4 Drawing Figures

WEB INDICIA FOR SYNCHRONIZING CONTROL APPARATUS FOR ELECTROPHOTOGRAPHIC APPARATUS UTILIZING DIGITAL COMPUTER

This application is a division of application Ser. No. 481,436, filed June 20, 1974, now U.S. Pat. No. 3,914,047, as a continuation of Appln. Ser. No. 402,223, filed: Oct. 1, 1973, now abandoned.

BACKGROUND OF THE INVENTION

1. Field Of The Invention

This invention relates to apparatus for controlling the operation of work stations in apparatus such as electrophotographic copying apparatus.

2. Description Of The Prior Art

In a common form of electrophotographic copying apparatus, an electrical image of an information medium such as a document is formed on an electrophotosensitive member in response to image-wise actinic radiation from the medium. The electrophotosensitive member includes a photoconductive layer with a conductive backing, and is transported along an endless path relative to a plurality of work stations, each of which is operative when actuated to perform a work operation on the electrophotosensitive medium. Such stations include a charging station at which a uniform charge is placed on the photoconductive layer, an exposure station at which the charged photoconductive layer is image-wise exposed to actinic radiation from the medium to create an electrostatic image of the medium in the photoconductive layer, a developing station at which the electrostatic image is contacted with finely divided charged toner particles for adhering to the photoconductive layer in a configuration defined by the electrostatic image, a transfer station at which such toner particles are transferred in the image configuration to a receiving surface, and a cleaning station at which residual toner is removed from the photoconductive layer so that it can be reused.

In applications in which the electrophotosensitive medium is continually reused, it can be constructed in a form of a drum, a plate or an endless web. The endless web configuration has certain advantages and disadvantages over drums and plates. Among the advantages is the fact that such a web can be disposed in flat configuration at one location in the apparatus to facilitate some operations such as, e.g., exposure and in curved configurations at other locations to facilitate other operations such as separation of a transfer sheet therefrom. Moreover, with web configurations more than one image may be in process at any given time. Among the disadvantages is the increased complexity of the system resulting from a need to sequentially actuate work stations in timed relation to web movement when a number of copies are being made.

SUMMARY OF THE INVENTION

It is an object of this invention to provide for use in an electrophotographic copying apparatus improved apparatus for controlling the sequential actuation of work stations and coordinating such actuations with the number of copies to be made.

In accordance with a preferred embodiment of this invention, there is disclosed an elongated electrophotosensitive web defining a plurality of selectable image areas and indicia such as a plurality of perforations. The web is movable along an endless path relative to a plurality of actuable work stations wherein each work station when actuated performs an operation in conjunction with the web. The apparatus includes means disposed at the path for sensing the indicia to produce signals representative thereof and a logic and control unit having a digital computer with a stored program which is responsive to such signals for sequentially actuating and de-actuating the work stations in accordance with the program in timed relation to movement of the web past predetermined positions along the endless path to effect sequential operations of such work stations with respect to a selected image area during movement of said area around said endless path.

DETAILED DESCRIPTION OF A PREFERRED EMBODIMENT

To assist the understanding of the present invention, the operation of an electrographic copying machine in which the invention may be used will be briefly described. It is to be understood, however, that the apparatus of the present invention could be used with equal facility and advantage in other copying machines and, therefore, that the following description of apparatus related to but not forming part of the invention is provided for illustrative purposes only.

ELECTROGRAPHIC COPY APPARATUS

Figure 1:
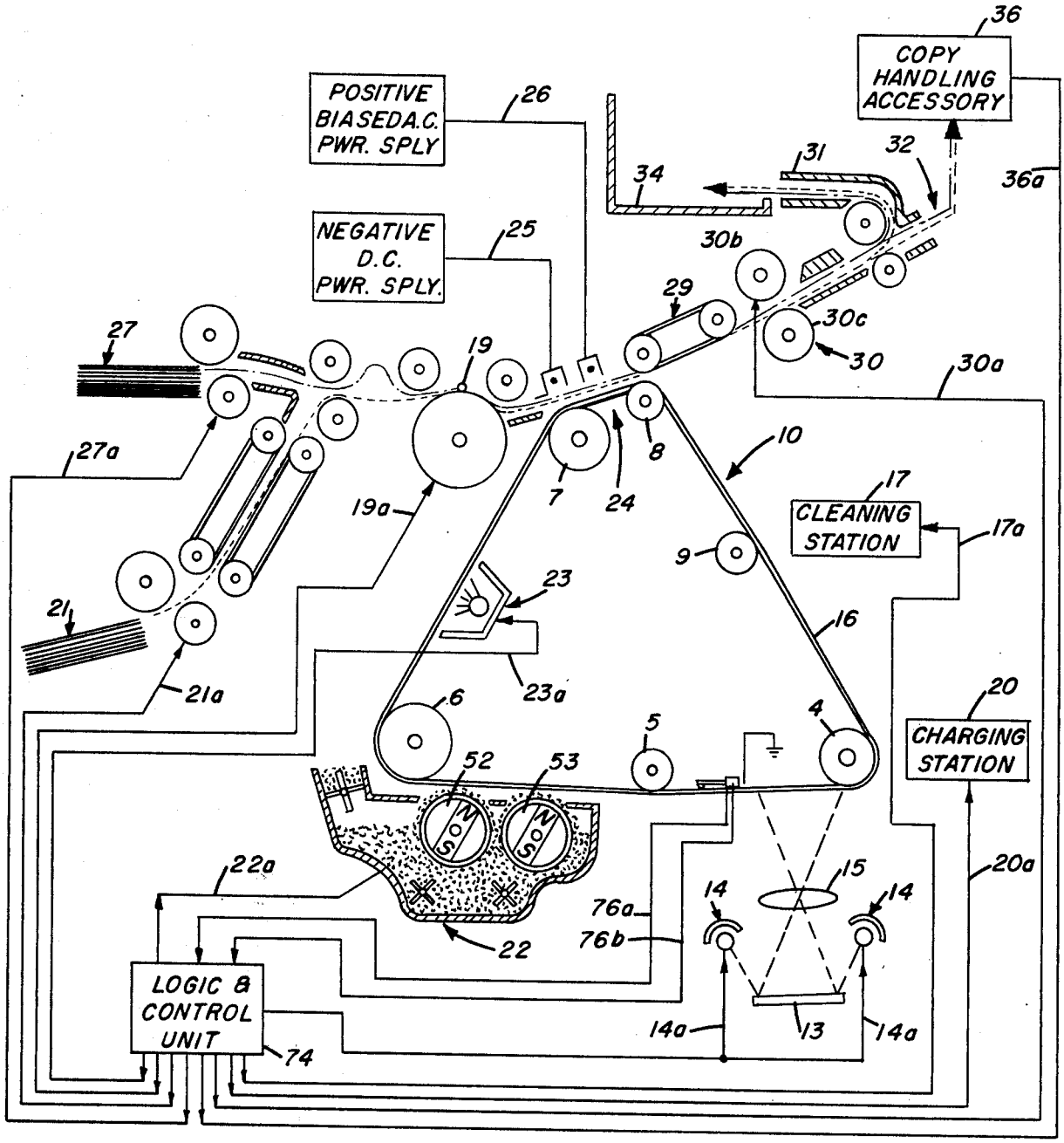
FIG. 1 is a block diagram showing the general arrangement of a web type electrophotographic copying apparatus in accordance with the invention.

Reference is now made to FIG. 1 wherein various stations of an electrographic apparatus 10 are schematically illustrated. The apparatus 10 includes logic and control unit (LCU) 9 having a programmable digital computer 74 and which in response to signals produced by sensors 76*a* and *b* which sense perforations in the edge of the web member 16 actuate work stations in timed relation to movement of the web past such stations. The LCU 9 is shown to have a number of leads which are individually connected to particular work stations respectively. It will be understood that at the stations there will be appropriate electromechanical devices which are responsive to such signals to perform the indicated work operation. Further, although not shown, there may where appropriate, be suitable return leads which signal the LCU when a work operation is completed and/or where there has been a machine station malfunction. As shown, an information medium 13 such as a document is adapted to be illuminated by radiation from Xenon flash lamps 14 when they are actuated by a signal transmitted by a conductor 14*a* coupled to the unit 9. Such radiation is reflected from the medium and projected by a lens 15 onto a photosensitive member 16 shown as a web to selectively dissipate charge and form an electrostatic latene image. It will be understood that the exposure station may include a programmable power supply for the Xenon flash lamps 14. A computer may cause the output voltage of the supply to vary as a function of the number of copies made to thereby compensate for the V white shift of the photoconductive layer of the web member 16 as a function of photoconductor usage. Towards this end, a computer (to be described later) may count the number of copies made and produce a four-bit digital word representative of ranges thereof. The digital word may be applied to four resistor terminals of the supply which are coupled to an operational amplifier which has a controllable output voltage. The web member 16 is trained about rollers 4 through 9 (only one of which may provide the driving force) and is uniformly charged at a charging station 20 with a negative DC charge. The charging station 20 includes a power supply and a corona wire structure (both not shown) which is operative when actuated by a signal transmitted by a conductor 20*a* from the LCU 9 to provide a generally uniform electrostatic charge on the web 16. Alternatively, the charger 20 may be continuously on. Assuming that the information on the document 13 is black on a white background, the photoconductive layer of web member 16 is rendered conductive in areas corresponding to the original background leaving a latent image of negative charge only in areas corresponding to the original black image. The photosensitive web member 16 which is relatively transparent may include a photoconductive layer with a conductive backing on a polyester support. The photoconductive layer may be formed from, for instance, a heterogeneous mixture of bisphenol A-polycarbonate binder, a triarylmethane organic photoconductor birylum sensitizing dye. For more specific disclosures, see commonly-assigned U.S. Pat. Nos. 3,615,406 and 3,615,414 both issued Oct. 24, 1971.

The apparatus 10 further includes a magnetic brush development station 22 at which the moving electrostatic image is contacted by toner particles formed from a fine thermoplastic powder which adheres by electrostatic attraction to the negatively charged portions of the electrostatic image to develop and render such image visible in an image-wise configuration. A post-development erase lamp 23 operated by a signal from the LCU from lead 23*a* then illuminates the latent electrostatic image to reduce photoconductor fatigue (deterioration resulting from prolonged charge) and to facilitate subsequent toner image transfer. The toner remains in its image-wise configuration on the surface of the web member 16 by adhesive and other forces of attraction. Also, because the toner is formed from a thermoplastic insulating material, it will retain its positive charge even though it may be illuminated by light from the lamp 23 which illuminates the web member 16. The magnetic brush station 22 includes brushes 52 and 53. An example of an exemplary magnetic brush station 22 is set forth in commonly assigned U.S. Pat. No. 3,543,720 to Drexler et al. The logic and control unit 9 may control the potential applied to the station 22 by varying the voltage which a lead 22*a* couples to a development station electrode (see FIG. 4).

A transfer station 24 is provided to cause toner particles to be transferred in an imagewise configuration to a receiving surface of a copy sheet of paper which is fed from a selected one of two paper supplies 21 or 27 through a registration device 19 controlled by the LCU by lead 19*a* and then onto the surface of the web member 16 at the transfer station 24. The logic and control unit 9 actuate the sheet feeders for the supplies 21 and 27 by means of conductors 21*a* and 27*a* respectively. Various forms of suitable sheet feeders are known in the art; the sheet feeder disclosed in commonly assigned U.S. Pat. No. 3,744,900 entitled, *PAPER FEED AND EXPOSURE SYNCHRONIZER*, to Jorgen Reesen, issued July 10, 1973, is suitable for use with the apparatus 10. The transfer station includes a negatively charged DC corona device 25 that applies a negative charge to the back of the copy paper, and simultaneously draws the paper by electrostatic attraction into intimate contact with the web member 16. Due to the charge gradient between the paper and the photoconductive layer of web member 16, the toner on the web member is transferred in an imagewise configuration onto the paper. The paper and web member 16 then move under an AC corona device 26 which removes the charge from the paper and renders it virtually neutral in charge. A positive bias is applied to the AC power supply for the corona 26 to overcome the tendency of balanced AC corona devices to produce a negative charge.

Figure 4:
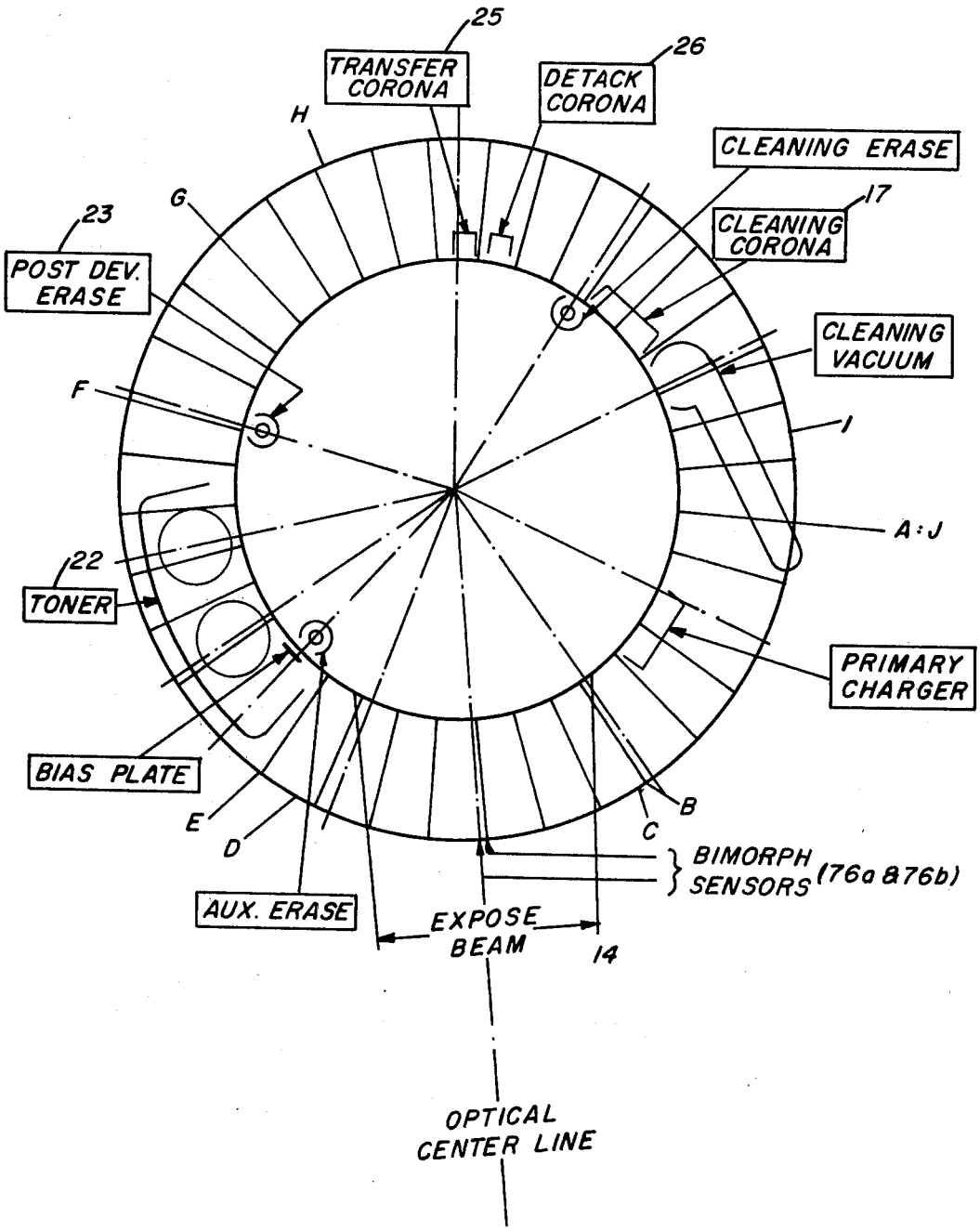
FIG. 4 is a diagram which shows the timing cycle of the apparatus shown in FIG. 1.

When the paper reaches the position on the web member 16 just above the roller 8, the web member 16 bends sharply around the roller and the beam strength of the paper coupled with the momentum of the moving paper causes the paper to continue in an essentially straight-line path and leave the web member 16. A vacuum transport member 29 is located above the photoconductor at this point to convey the paper in such straight-line path into a fusing station 30 controlled by a lead 30*a*. At the fusing station 30, the toner is heated and fused into the paper to provide a final substantially permanent copy. This copy follows either of the paths labeled 31 or 32 in exiting from the machine to either a hopper 34 or a copy handling accessory 36 such as a sorter, as controlled by the logic unit 9 through lead 36*a*. Finally, a cleaning station 17 is provided in which residual toner is removed from the photoconductive layer of the web member 16 prior to charging. The cleaning station 17 may include an erase lamp, cleaning corona (see FIG. 4), actuable in response to a signal conducted by a lead 17*a* from the logic and control unit 9. As shown in FIG. 4, the station 17 may include a cleaning vacuum system. In certain known modifications of this same apparatus, one or more of these stations may be eliminated or modified. For a more complete description of the general organization of another such electrographic apparatus, reference is made to commonly assigned U.S. Pat. No. 3,746,443 issued July 17, 1972 entitled, *MAGNETICALLY CONTROLLED MACHINE PROGRAMMER*, to Hickey. It will be understood to those skilled in the art that a plurality of (in this instance, six) electrostatic and toner images may be placed sequentially on successive portions of the web as it moves along the endless path so that the above discussed work operations performed at the work stations occur in proper timed sequence on different portions of the web which correspond to selected image areas.

Figure 2:
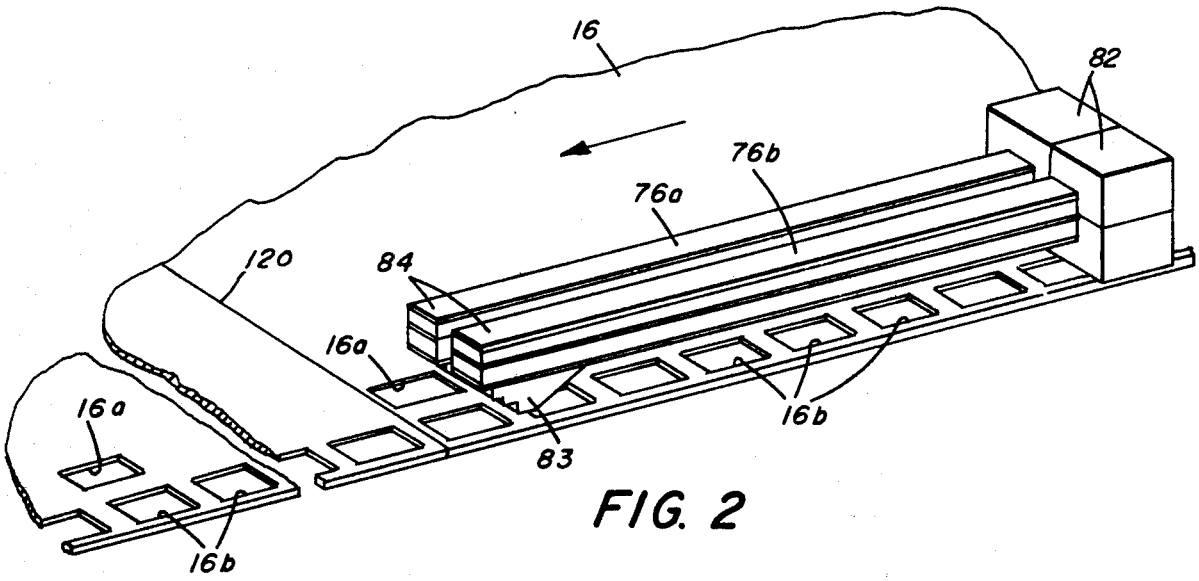
FIG. 2 is a partial perspective view showing in detail a portion of the photoconductive web and bimorph sensors also shown in FIG. 1.

Reference should now be made to FIG. 2 which shows in detail a portion of the web member 16 having along its border two rows of indicia or perforations 16*a* (also referred to herein as F perforations or C perfs) and 16*b* (also referred to herein as C perforations or perfs). Between adjacent perforations 16*a* is defined an image area. By that it is meant an image area is a place across the entire width of the web member 16 wherein a charge pattern corresponding to an image may be placed. The row 16b defines a predetermined number (viz., 51) of equally spaced perforations or sprocket holes disposed between adjacent perforations 16a which too are equally spaced along the web member 16, the distance between adjacent perforations 16a being much greater than that between adjacent perforations 16b. As shown, the birmoph F perf sensor 76a which is adapted to sense the perforations 16a and provide a signal to the digital computer 74 each time a perforation 16a is sensed. The second bimorph C perf sensor 76b is adapted to provide a clock pulse to the computer 74, each time a perforation 16b is sensed. The computer 74 uses the pulses from both bimorph sensors 76a and *b* to control and synchronize the various work stations of the electrophotographic operation. In operation, upon receiving a clock pulse from a bimorph sensor 76a, the computer 74 enables the start line (briefly seen in FIG. 3) which causes bits to be entered into appropriate registers in the computer. The computer 74 controls the synchronization of various work stations with respect to the moving image areas. For example, computer 74 controls the operation of the sheet feeding apparatus and the operation of the exposure lamps 14 at the appropriate times in the machine cycle. The computer 74 may take various other forms known in the art some of which are commercially available as programmable minicomputers and programmable microprocessors. Specific examples are Model 8008 Micro-Computer manufactured by Intel Corporation of Santa Clara, California; GEPAC 30-manufactured by the General Electric Corporation; Interdata Model 1 or Varian Data Machines Model 520/i. The instructions and method of programming such minicomputers is set forth in the textbook, "Minicomputers for Engineers and Scientists," Gravino Korn (1973).

An example of bimorph sensors 76a and 76b which may be suitable for use with the present invention is described in commonly assigned U.S. Pat. No. 3,723,650 in the name of Bradley et al, issued Mar. 27, 1973, entitled, *METHOD AND APPARATUS FOR DERIVING THE VELOCITY AND RELATIVE POSITION OF CONTINUOUSLY MOVING INFORMATION BEARING MEDIA*. Briefly, such bimorph sensors include a piezoelectric crystal 82 which has attached thereto a single step sensor 83 element, the distal ends 84 of which bear on and slide against the moving web member 16. When a perforation in the web member 16 moves beneath the distal end of the sensor element, the end abruptly drops over the leading edge of the perforation and distorts or otherwise induces mechanical movement of its associated transducer. As the web member 16 continues to move, the distal end 84 of the sensor element 83 is forced out of the perforation by engagement with the trailing edge of the perforation, and once again the sensor element distorts its associated piezoelectric transducer. By means of electrodes or other suitable current collecting means attached to the sensors, voltage signals generated by the distortion of the transducer are transmitted to the computer 74. Other types of perforation sensors which produce output signals such as optical perforation sensors or other types of ceramic transducers responsive to compression, bending or other forms of physical distortion may be substituted for the depicted bimorph sensors.

COMPUTER OPERATION

General: Because programming of minicomputers is a conventional skill, the particular details of the program for operating the computer 74 will not be given. The following disclosure would enable a programmer having ordinary skill in the art to produce an appropriate program for the computer 74. The particular details of any such program would, of course, depend upon the architecture of the selectable computer.

Figure 3:
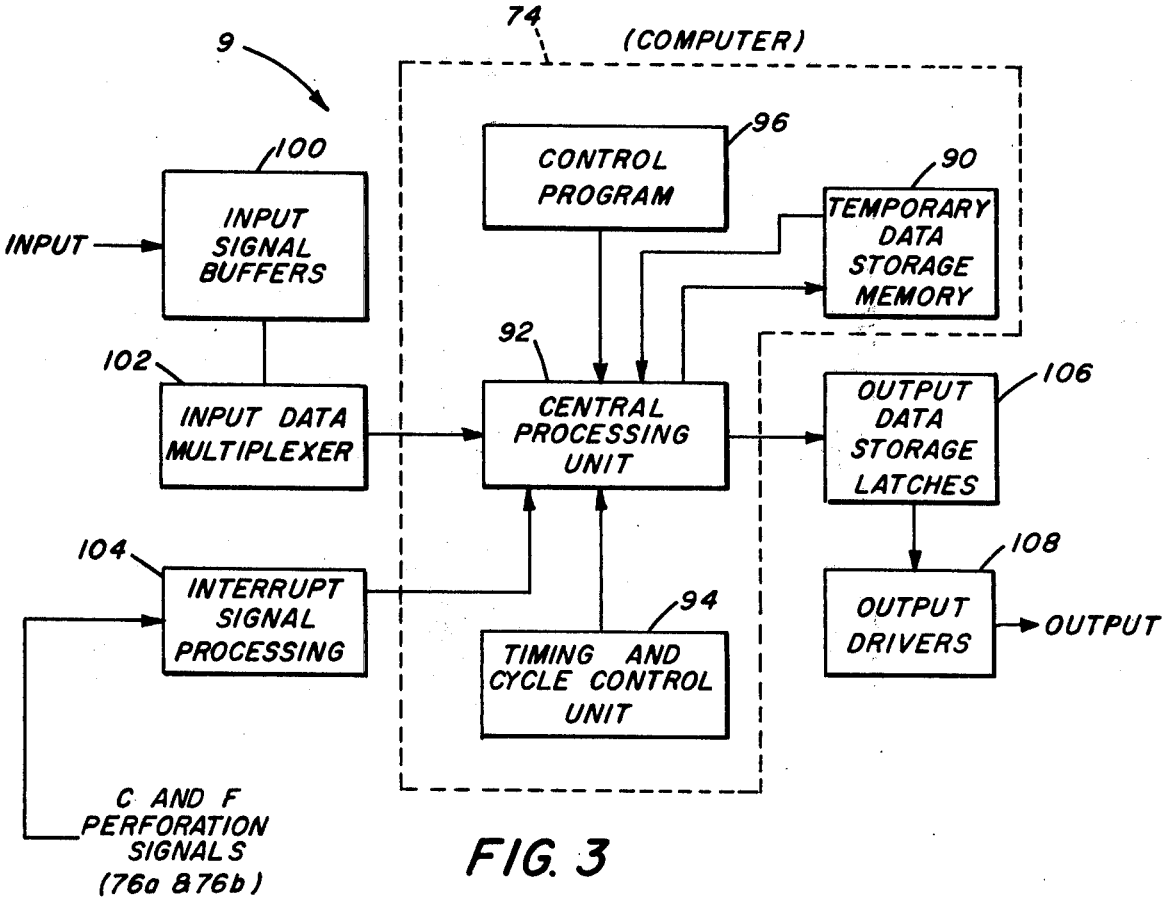
FIG. 3 is a block diagram of the logic and control unit shown in FIG. 1 for controlling the actuation of various work stations in the electrophotographic apparatus shown in FIG. 1.

Turning now to FIG. 3, a block diagram of the Logic and Control Unit (LCU) 9, which interfaces with the various electromechanical subsystems, is shown. The LCU 9 consists of temporary data storage memory 90, central processing unit 92, timing and cycle control unit 94 and a stored program control 96. Data input and output is performed sequentially under program control. Input data is either applied through input signal buffer 100 to a multiplexer 102 or from the bimorph sensors 76a and *b* which indicate C or F perforations, respectively. The input signals to the signal buffer 100 consist of logic level digital signals which are derived from various switches, sensors and analog to digital converters. The output data and control signals are applied to storage latches 106 which provide inputs to suitable output drivers 108 directly coupled to the leads for the work stations. More specifically, the output signals from the LCU are logic level, digital signals which are buffered and amplified to provide drive signals to various clutches, brakes, solenoids, power switches and numeric displays in the various work stations. The LCU processing functions can be programmed by changing the instructions stored in the computer memory. This provides a flexible machine logic and timing arrangement and extends the LCU capability to include the capacity for performing service diagnostics. For example, if an input signal is not delivered to the LCU at the appropriate time, the LCU can display an ERROR code on the control panel. This ERROR code would be an indication of a machine failure and could be used during servicing to indicate the specific nature of a machine failure. In accordance with a feature of the invention, a service input connector may be provided which interfaces with an external service box to facilitate diagnostics to be performed under control of the serviceman. During a copy cycle, the LCU executes the stored program which controls the processing of signal inputs to the LCU and initiates turn ON, turn OFF and timing of output control signals, respectively.

The time sequence of machine control signals is critical to the copy cycle because machine stations and associated mechanisms (often referred to as events) must be powered ON and OFF in the correct sequence to assure high quality copy and preventing paper misfeeds, misregistration and erratic operation. The primary mechanism for controlling the time sequence of events and their relationship to each other is as noted above, to sense the location of the image elements as they continuously cycle, and synchronize the various control mechanisms to the location of the image elements. The mechanisms for accomplishing this as previously noted is to sense perforations which are spaced equidistant along the edge of the web member 16. The web member as noted above is divided into six image areas by F perfs and each image area is subdivided into 51 sections by C perfs.

Machine sequencing control is implemented in the LCU by converting signal timing and combinational logic requirements to programs that control the LCU computer. These control programs establish the basic operating mode and sequence of events for the machine subsystems.

COPY CYCLE CONTROLS

The electrophotographic cycle is selected and initiated by actuation of switches on a conventional operator's control panel (not shown). The appropriate switch on the panel may be selected for one or two sided copying. The LCU 9 accepts input signals from the operator's panel, stores the signals in the computer memory 90, and decodes the signals to select the program which will initiate and control the electrophotographic cycle. In addition to selecting a machine operating mode, the operator input panel is also used to select a quantity of copies. This information also stored in the LCU computer memory 90, is compared to the quantity of copies completed during the cycling of the machine. Upon delivery of the requested number of copies, the LCU develops output signals to de-activate the copying mode.

During the copy cycle, signals are derived from the two separate perforation sensors 76*a* and 76*b*. These sensors produce the F and C perf signals respectively, which are the primary control signal inputs to the LCU during the copy cycle, and are the synchronizing signals for the control of the other events during the cycle.

The location of the sensors 76*a* and 76*b* along the path of the web member 16 is known and fixed. The F perf sensed signal is utilized to activate the exposure station 14; thus, the location of an active image element relative to the F perf is known. The designation F perf should now be understood to be with reference to initiating flash exposure. Consequently, the location of the active image element relative to the various mechanisms is also known.

By counting and storing the number of F perf signals, the flash signals, the LCU computes the quantity of active image elements on the film. The C perfs provide sufficient granularity of the position of the web to be able to predict (within one C perf spacing), the location of the active image elements during the time interval between F perf signals. Thus, the designation C perf should now be understood to be with reference to providing "clock" type signals.

By counting F perfs and C perfs and storing the information along with fixed data, such as the maximum number of active image elements and distance between perfs on the film, the LCU can compute where each active and inactive image element is with respect to the F perf sensor. This information is combined with knowledge of the spacing between various mechanisms along with film path to develop control equations which activate these mechanisms at the required point in the cycle. Thus, the speed of the web member 16 is not required to be precisely known. The length of web member 16, spacing between perforations and location of mechanisms with respect to the F perf sensor must be known and fixed.

Through this counting and computing mechanism, the LCU 9 controls the copy cycle and activates the stations which perform the required operation in the processing of each active and inactive image element on the film. As noted, the mechanism for selecting the appropriate input signal processing technique, is a program stored in the LCU computer. Since the computer 74 cannot operate on all inputs and outputs simultaneously, a technique for selecting those signals to be processed, during each phase of the copy cycle, has been developed. Again, the F perf and C perf are the key factors to selecting the appropriate control programs. As mentioned before, the F perf and C perf signals are counted and stored in the memory 90 of the LCU computer. The location of active and inactive elements along the film path can be determined from the F perf count and C perf count. Thus, those signals, critical to the process, that should be occurring at any particular count to the cycle, can be selected for processing by the LCU. Other noncritical signals are processed periodically, when the LCU is not required to recognize a C perf or F perf signal. The C perf and F perf signals override other inputs to the LCU, by interrupting the computer, thus the occurrence of these signals is always detected at the LCU. The use of a computer interrupt is well known in the computer art. For a complete explanation of same, see the above-referenced text, "Minicomputers for Engineers and Scientists".

A typical copy cycle consisting of a single copy illustrates the key control signals which are derived from knowledge of the position of the web member 16 and consequently the active image area position. The spatial relationship of various elements of the electrophotographic copier are shown in FIG. 4. The film path is represented by the inner circular path on the annulus. The pictorial representation is subdivided into 10 degree segments. C perforations spacing is approximately 1.17 degrees in this representation. The letters A through J are used to indicate the location of the leading edge of an image as the web member 16 cycles clockwise around the film path. Note that the perforations are located midway along the image area and the web member 16 contains six F perforations. The two bimorph sensors 76*a* and *b* positioned at points shown on the diagram sense the passage of F and C perforations.

The image area, occupies approximately 60° on this representation, i.e., i.e., ± 30 either side of the F perforation. Interframe spacing is maintained to eliminate image overlap and provide a space for a splice 120 (FIG. 2) in the web member 16. The signals developed by the LCU computer during the copy cycle are indicated in timed sequence in Table I. The letters correspond to the location of the leading edge of the image area as the web member 16 rotates through the cycle required for a single copy.

For multiple copies, the sequence continues as an element is exposed after each F perforation occurrence subsequent to event D on the timing diagram. The LCU computer stores information relating the location of each active element to the controlled events and maintains in storage, a record of quantity requested, quantity in process and quantity delivered to the sorter or top exit hopper. The data stored in LCU computer memory is interrogated and updated on the occurrence of each F perforation, C perforation and timed signal output.

Table II illustrates the information stored in the LCU during a multiple copy cycle, a RUN FLIP-FLOP and a PRINT FLIP-FLOP although not shown will be understood to be located in the central processing unit 92 of the computer 74 are are actuated by depressing the START button. When the stored C count reaches 51 and an F perforation is detected, the LCU stores a logical one in a six bit film shift register disposed in the processor 92. When BIT-3 of the film shift register (FSR) is high, a logical one is sent to a paper shift register (PSR) also. As the cycle continues, additional bits are shifted and stored in the FSR and PSR. These bits define the position of active image elements and paper feed functions remaining in the cycle.

When coincidence between the process counter and copies requested counter is reached, the PRINT FLIP-FLOP is reset. This resetting causes successive F perforation signals to clear the FSR and PSR as indicated in the table. As successive F perforations are detected, the shift registers are finally cleared, the end of the cycle is reached, and the machine is set in a stand-by mode.

TABLE I

SEQUENCE OF EVENTS FOR SINGLE COPY RUN

| FIGURE 4 FILM POSITION | CONTROLLED EVENTS |
|---|---|
| A | START Switch Actuated |
| | System Operate ON* |
| | Primary Charger ON |
| | Auxiliary Erase ON |
| B | Reset C Perforation Count to Zero |
| C | Illumination Power Supply "Initiated" |
| D | Flash Exposure |
| E | Auxiliary Erase OFF |
| | Monitor Enable ON |
| F | Auxiliary Erase ON |
| | Primary Charger OFF |
| G | Paper Feed |
| H | Transfer Charger ON |
| | Detact Charger ON |
| I | Transfer Charger OFF |
| | Detact Charger OFF |
| J | STOP |
| | System Operate OFF |

*The system which is operated includes — shutter drive motor in exposure station 14, erase station 23, cleaning station 17 and paper feed vacuum in stations 21 and 27.

control signals for a machine shutdown with indication to the operator to check the paper path. The machine jam detection logic incorporates signal sensing and control which reduces the potential of mechanism damage caused by a paper jam.

MISFEED LOGIC

If paper is not fed from the supply, the failure is classed as misfeed and does not result in a machine shutdown. If a single misfeed occurs, the computer 74 adjusts the paper shift register contents to account for the loss of one copy in the control logic. If two consecutive misfeeds occur, the paper in the paper path completes the transition through the printer to an exit and the machine is shut down. The number of copies processed and delivered is stored in the LCU computer 74 and the check paper path indicator is turned ON. The operator would normally clear the misfeed sheets and restart the copy cycle. Since the delivered count is stored during the misfeed recovery, the cycle restarts where it left off and the number of copies required to complete the run are delivered to the exit.

PAPER SUPPLY CONTROL

The paper supply system, although not shown, may consist of two elevator mechanisms and a vacuum oscillator feed mechanism which transfers paper from the elevator stack to the paper transport mechanism.

Each of the two paper feed and elevator supply mechanisms could include, say five microswitch input signals to the LCU. These signals would be (1) supply seated, (2) add paper, (3) out of paper, (4) elevator down, (5) elevator up.

The LCU 9 processes these signals and develops three output signals for each paper supply which controls the drive mechanisms to move the elevators up or down. In normal operating conditions, the selected

TABLE II

SEQUENCE OF EVENTS FOR MULTIPLE COPY, ONE-SIDE COPY MODE

| | RUN FLIP-FLOP | PRINT FLIP-FLOP | 5 BIT (FSR) FILM SHIFT REGISTER | 8 BIT (PSR) PAPER SHIFT REGISTER | C COUNT | F COUNT |
|---|---|---|---|---|---|---|
| Start | 1 | 1 | 0 don't care | 0 don't care | don't care | 0 |
| | 1 | 1 | 00001 | 00000000 | 51 | 1 |
| | 1 | 1 | 00011 | 00000000 | 51 | 2 |
| | 1 | 1 | 00111 | 00000001 | 51 | 3 |
| | 1 | 1 | 01111 | 00000011 | 51 | 4 |
| | 1 | 1 | 11111 | 00000111 | 51 | 5 |
| | 1 | 1 | 11111 | 11111111 | 51 | 10 |
| (Processed) | 1 | 0 | 11110 | 11111111 | 51 | 11 |
| (Requested) | 1 | 0 | 11100 | 11111111 | 51 | 12 |
| | 1 | 0 | 11000 | 11111110 | 51 | 13 |
| | 1 | 0 | 10000 | 11111100 | 51 | 14 |
| | 1 | 0 | 00000 | 11111000 | | 15 |

PAPER PATH

The paper path is shown in FIG. 1. As discussed with respect to the timing diagram (FIG. 4), the paper feeding is initiated by the LCU 9. Paper registration is accomplished by mechanical means and is controlled by the registration mechanism 19. A number of sensors may be located along the paper path to detect paper feeding or misfeeds and produce signals to the LCU at properly selected positions. These signals may include (1) leading edge detector in the paper feed mechanism, (2) transfer jam detector, (3) side exit/top exit jam detectors, (4) sorter jam detection. The jam signals are monitored by the LCU computer and in the event of a paper jam, the computer 74 is programmed to develop supply is seated and is driven up until stacked paper contacts switch 5, which is sensed by the LCU and results in turn OFF of the drive. The drive remains OFF until a sufficient quantity of paper is removed from the stack to allow switch 5 to open. This switch opening causes the drive to be activated until a switch closure is detected. The cycle repeats until the paper supply is low, indicating by switch 2. Switch 2, closure is sensed by the LCU and an ADD PAPER signal is sent to the control and display panel. If the ADD PAPER signal is ignored, the supply is eventually exhausted and the elevator is driven down to the load paper position indicated by switch 4. The load paper indicator remains ON until switch 1 is cycled (indicating paper was loaded), or the operator selects the alternate supply.

The LCU incorporates logic to determine if both supplies 21 and 27 are exhausted and inhibit the READY light until one of the two supplies 21 or 27 has been loaded. Provision is also incorporated to sense a switch failure and as a result indicate a CHECK PAPER PATH condition at the control panel.

The LCU computer 74 synchronizes the operation of the feeder and the machine copy cycle by generating timing signals in leads 21*a* and 27*a* (FIG. 1) that control the feeder drives. The LCU receives a power ON input signal from the feeder which enables power to the feeder drive mechanisms. The paper feed cycle is initiated by the START control located on the control panel.

DOCUMENT FEEDER CONTROL (NOT SHOWN)

Document feed is controlled by the LCU computer 74 during the copy cycle.

The cycle is reinitiated automatically following completion of the selected number of copies, when additional originals are present in the original document hopper. When the last input document is fed to the platen by a feeder (not shown), the document feeder PAPER PRESENT switch indicates an empty condition and feeder shutdown is initiated.

A paper misfeed in the document feeder is detected if the paper feed cycle is incomplete after a predetermined time period.

SORTER OR ACCESSORY CONTROL

The sorting cycle is initiated by the LCU computer by means of lead 36*a*. The sorting process is controlled by logic circuitry contained in the sorter 36. The sorter cycle is initiated by the LCU computer when the paper path SORTER EXIT switch is selected on the control panel. The sorter delivers a jam signal to the LCU in the event of paper misfeeds in the sorter. The sorter also develops a count signal when each copy is delivered to the appropriate slot in the sorter. This count signal is used to actuate a counter in the LCU computer and the accumulated count is stored in a register in the LCU computer.

FUSING CONTROL

The LCU interface with the fusing station is shown schematically in FIG. 1 by lead 30*a*. The fusing station includes a conventional pressure roller 30*b* which is movable into contact with a heated fusing roller 30*c*. The application of pressure on the fusing roller 30*c* is initiated at the start of the print cycle. Pressure is maintained on the fusing roller 30*c* until the last copy of a sequence has passed through the fuser 30. A temperature ready sensor external to LCU supplies an input signal to the LCU which indicates the fusing roller is at operating temperature. If the fusing roller 30*c* is below operating temperature, the LCU inhibits the machine from operating. Loss of pressure on the fusing roller 30*c* is sensed at the LCU computer and results in a machine shutdown.

A wicking pump (not shown) may be employed in the fusing system. If the fusing system employs such a pump, such pump may be actuated by the LCU for a period of approximately four seconds at a repetition rate of, say, once every 30 seconds. This is accomplished by maintaining a cumulative copy count in the LCU computer which controls the wicking pump.

The invention has been described in detail with particular reference to a preferred embodiment thereof, but it will be understood that variations and modifications can be effected within the spirit and scope of the invention.

We claim:

1. An electrophotographic web member for use in an electrophotographic copying apparatus having actuatable work stations located along the path of movement of said web member for performing work operations on selected image areas of said web member upon actuation thereof by control means to form copies therefrom, said web member including at least three juxtaposed consecutively usable image areas, a first set of indicia on said web member comprising at least three spaced indicium disposed in predetermined positions on said web member to define said at least three juxtaposed consecutively usable image areas, said first set of indicia being located on said web member to be moved past sensing means for sending a first set of signals indicative of the image areas to the control means which controls actuation of the work stations, said web member further including second sets of indicia, each of said second sets of indicia including a fixed number of indicium disposed within each image area, said second sets of indicia being located on said web member for moving past sensing means for sending clock type signals to the control means indicative of the fixed number during the time interval between consecutive signals from said first set of indicia whereby the control means may count and store the signals from both sets of indicia to assure that the fixed number from said second sets is counted during the time interval and to thereby assure actuation of the work stations in a proper predetermined time sequence.

2. The invention as set forth in claim 1 wherein said web member is a continuous loop and said indicia of said first and second sets are spaced along an edge of said loop.

3. The invention as set forth in claim 2 wherein said loop includes a splice area disposed between two juxtaposed consecutively usable chargeable areas.

4. The invention as set forth in claim 3 wherein said indicia of said first and second sets are perforations, with indicium of said first set being spaced equidistantly along the loop and indicium of said second set being spaced equidistantly along the loop.

5. The invention as set forth in claim 2 wherein said first and second sets are spaced along the same edge of said loop.

6. The invention as set forth in claim 1 wherein each set of said second sets of indicia includes a plurality of indicium.

7. The invention as set forth in claim 1 wherein each indicium of said first set of indicia is in line with an indicium of said second set of indicia.

8. The invention as set forth in claim 7 wherein the aligned indicium are separate perforations.

9. The invention as set forth in claim 1 wherein said web member is endless to form a closed loop having an endless path, and said web member includes a support layer having an electrically conductive surface and a superposed photoconductive surface in electrical contact with said electrically conductive surface.

10. The invention as set forth in claim 1 wherein each set of said second sets of indicia comprises fifty-one indicium for each indicium of said first set of indica, and there being a total of six indicium in said first set of indicia.

11. The invention as set forth in claim 10 wherein said indicia of said first and second sets are perforations spaced along the same edge of said web member, said indicium of said first set being spaced equidistantly from each other, said indicium of said second set being spaced equidistantly from each other, and each indicium of said first set being in line with an indicium of said second set.

12. The invention as set forth in claim 1 wherein said indicia of said first and second sets are perforations spaced along the same edge of said web member, said indicium of said first set being spaced equidistantly from each other, and said indicium of said second set being spaced equidistantly from each other.

13. The invention as set forth in claim 9 wherein said indicia of said first and second sets are perforations, with indicium of said first set being spaced equidistantly along the loop and indicium of said second set being spaced equidistantly along the loop.

14. The invention as set forth in claim 9 wherein each set of said second sets of indicia includes a plurality of indicium.

* * * * *